US009887520B2

(12) United States Patent
Zeh

(10) Patent No.: US 9,887,520 B2
(45) Date of Patent: Feb. 6, 2018

(54) METHOD FOR PRODUCING A SPARK PLUG

(71) Applicant: Federal-Mogul Ignition GmbH, Neuhaus-Schierschnitz (DE)

(72) Inventor: Andreas Zeh, Sonneberg (DE)

(73) Assignee: FEDERAL-MOGUL IGNITION GMBH, Neuhaus-Schierschini (DE)

( * ) Notice: Subject to any disclaimer, the term of this patent is extended or adjusted under 35 U.S.C. 154(b) by 0 days.

(21) Appl. No.: 15/211,810

(22) Filed: Jul. 15, 2016

(65) Prior Publication Data

US 2017/0025826 A1 Jan. 26, 2017

(30) Foreign Application Priority Data

Jul. 23, 2015 (DE) ..... 10 2015 112 038
Nov. 4, 2015 (DE) ..... 10 2015 118 935

(51) Int. Cl.
*H01T 21/06* (2006.01)
*H01T 13/20* (2006.01)
*H01T 13/39* (2006.01)

(52) U.S. Cl.
CPC ..... *H01T 21/06* (2013.01); *H01T 13/20* (2013.01); *H01T 13/39* (2013.01)

(58) Field of Classification Search
CPC ..... H01T 21/00–21/06; H01T 13/20; H01T 13/26; B23H 9/00; B23H 9/02; B23K 26/26; B23K 26/361; B23K 26/38
See application file for complete search history.

(56) References Cited

U.S. PATENT DOCUMENTS 6,362,562 B1 3/2002 Rossi
6,583,539 B1 6/2003 Zamora
7,637,793 B2 12/2009 Lintunen
8,517,786 B2 8/2013 Musasa
8,519,607 B2 * 8/2013 Kowalski ..... H01T 13/467 313/118

(Continued)

FOREIGN PATENT DOCUMENTS

DE 102007042790 A1 3/2009
DE 102015103666 B3 1/2016
JP 10055873 A * 2/1998

OTHER PUBLICATIONS

German Office Action for Application No. 102015118935.6 dated Mar. 2, 2016, 4 pages.

*Primary Examiner* — Mariceli Santiago
(74) *Attorney, Agent, or Firm* — Reising Ethington, P.C.

(57) ABSTRACT

A method for producing a spark plug for internal combustion engines, in particular for gas-powered internal combustion engines, having a metallic shell, a ceramic insulator held in the shell, a center electrode embedded in the insulator, at least one ground electrode attached to a front end of the shell, an end piece made of a precious metal and/or alloy attached to a front end of the center electrode, and a counterpart made of a precious metal and/or alloy attached to the ground electrode opposite the end piece, between which is a spark gap with a nominal width. The spark gap is produced initially with a width that is smaller, at least in places, than the nominal width, and is subsequently brought to its nominal width by removing material from at least one of the two surfaces of the end piece and the counterpart that delimit the spark gap.

9 Claims, 4 Drawing Sheets

(56) References Cited

U.S. PATENT DOCUMENTS

| | | | | |
|---|---|---|---|---|
| 8,912,713 | B2 * | 12/2014 | DeSalvo | 313/141 |
| 2001/0015602 | A1 * | 8/2001 | Hori | H01T 21/06 313/141 |
| 2002/0055318 | A1 * | 5/2002 | Ishiguro | H01T 21/02 445/7 |
| 2009/0066211 | A1 | 3/2009 | Hartmann | |
| 2013/0187529 | A1 * | 7/2013 | DeSalvo | H01T 13/20 313/141 |
| 2016/0141842 | A1 | 5/2016 | Steiner | |

* cited by examiner

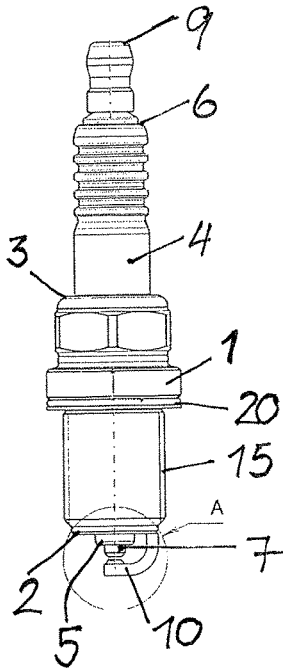
Fig. 1
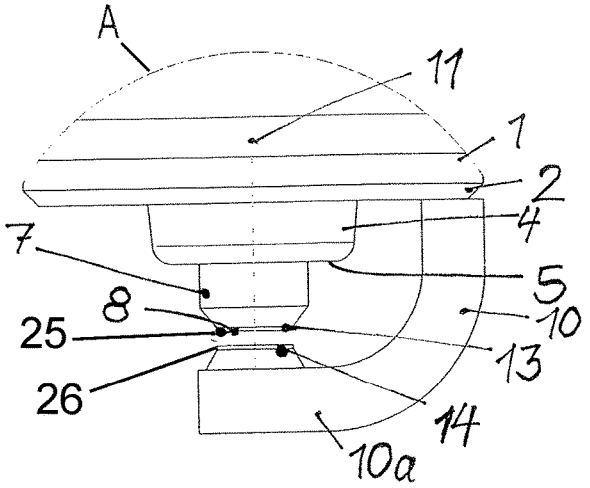
Fig. 2
Fig. 3
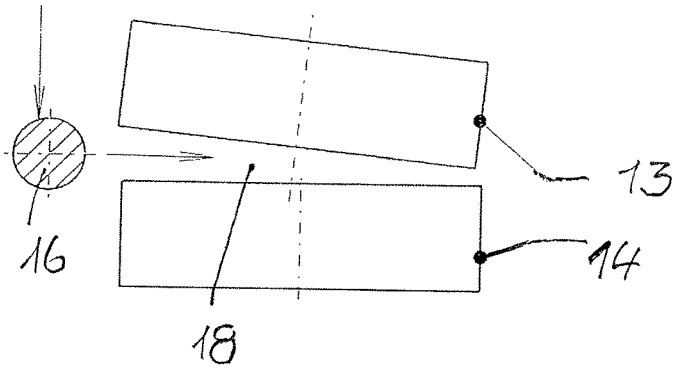
Fig. 4
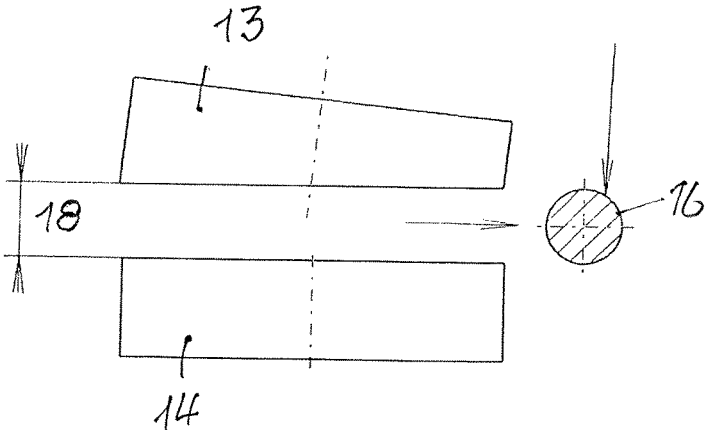

METHOD FOR PRODUCING A SPARK PLUG

This Application claims the benefit of German Application No. 10 2015 112 038.0, filed on Jul. 23, 2015 and German Application No. 10 2015 118 935.6 filed Nov. 4, 2015, the contents of which are hereby incorporated by reference in their entirety.

FIELD

The invention generally relates to a method for producing a spark plug with a center electrode that is tipped with an end piece made of a precious metal. Opposite the center electrode, a counterpart made of precious metal is welded onto the at least one ground electrode. The end piece and the counterpart delimit the spark gap.

BACKGROUND

Spark plugs for use in gas engines, especially in stationary gas engines are subject to special requirements; in particular, a long service life is demanded. In order to achieve this, it is important for the width and position of the spark gap to have the smallest possible dimensional tolerances. The cause of dimensional variations may reside in the fusing of the center electrode into the insulator, in the shrink-fitting of the insulator in the spark plug shell, in the process of crimping the back end of the spark plug shell, in the welding of the ground electrodes onto the front edge of the spark plug shell, and in the welding of the precious metal pieces onto the ground electrode and onto the center electrode, and bring about dimensional variations in the spark gap, deviations from parallelism of the surfaces bordering the spark gap, and deviations in the alignment of the center electrode and the precious metal counterpart on the ground electrode coaxial to the spark plug center line. Keeping these error sources as small as possible requires great manufacturing effort and is partly responsible for a high price of the spark plugs for gas engines.

SUMMARY

An object of the present application is to disclose a way that spark plugs of this type can be produced with less effort without sacrificing dimensional accuracy.

According to one aspect, there is provided a method for producing a spark plug for internal combustion engines, in particular for gas-powered internal combustion engines, having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and has a front end that projects from the front end of the insulator; and having a ground electrode that is attached to the front end of the shell;

wherein an end piece made of a precious metal or a precious metal alloy is attached to the front end of the center electrode, and a counterpart made of a precious metal or a precious metal alloy is attached to the ground electrode opposite the end piece, between which is formed a spark gap that is set to a nominal width;

The method may include the following production steps: the spark gap is produced initially with a width that is smaller, at least in places, than the nominal width; subsequently, the spark gap is brought to its nominal width by the removal of material from at least one of the two surfaces—of the end piece and of the counterpart—delimiting the spark gap.

It is preferable that the last of these two steps for creating the spark gap be the final step in manufacturing the spark plug, and at the same time, is the manufacturing step that is important for the accuracy of the width of the spark gap. All other manufacturing steps, which in the prior art affect the location, shape and width of the spark gap, have already been completed when the width of the spark gap is created by material-removing processing of the surfaces delimiting the spark gap—in other words, by trimming of the spark gap—so the preceding manufacturing steps are no longer able to adversely affect the accuracy of the spark gap. This has the further advantageous consequence that manufacturing steps that are performed prior to the trimming of the spark gap need not be performed with the same high accuracy as in the prior art in order to achieve an accurate spark gap, because the accuracy thereof is determined by the final manufacturing step of the method, namely by the trimming of the spark gap.

The trimming of the spark gap can be performed with high precision without special effort. In consequence, the use of the method results in improved accuracy while at the same time reducing manufacturing effort.

In order to manufacture a spark plug according to the method, it is possible to initially proceed as in the prior art: the shell of the spark plug, the insulator and the center electrode can be prefabricated separately. The ground electrode can be welded to the shell as usual. An end piece made of a precious metal or a precious metal alloy, for example a precious metal disk, can be welded onto the front end of the center electrode as usual. As counterpart thereto, a counterpart made of a precious metal or a precious metal alloy, for example another precious metal disk, can be welded onto the ground electrode. The center electrode is inserted into the insulator and is fused by one of its sections into the insulator. The insulator equipped with the center electrode can then be inserted into the shell of the spark plug from the back end, for instance pushed forward to a stop and secured by crimping the back end of the shell.

Advantageously, the spark gap is initially produced with a width that is no greater than the nominal width at any part of the spark gap. In this way, it is possible to ensure that the spark gap really obtains its nominal width at every point due to the trimming. If the spark gap is already no wider than the nominal width at the beginning of the trimming process, then the trimming process also does not make it any wider than the nominal width. However, the trimming process does enlarge the spark gap to the nominal width at the places where it had been narrower than the nominal width before the trimming process.

The removal of material from at least one of the two surfaces delimiting the spark gap, that of the end piece on the center electrode and that of the counterpart on the ground electrode, is preferably accomplished through electrical discharge machining. Using electrical discharge machining, the trimming can be accomplished with high accuracy. Moreover, electrical discharge machining is especially well suited for machining precious metal alloys, for example platinum-iridium alloys, which frequently are used for spark plugs and have the disadvantage that they can be mechanically machined only with difficulty because of their very high strength.

In spark plugs whose spark gap is located between the end face of the end piece of the center electrode and the end face of the counterpart facing it, which counterpart is attached to a ground electrode implemented as a front electrode, the nominal width of the spark gap preferably is produced by wire erosion. For this purpose, the tensioned wire for the erosion is guided along the surface of the end piece or of the counterpart to be machined at a distance required for producing the erosive sparkover until the desired width of the spark gap is achieved.

Instead of using wire erosion, the spark gap in a spark plug of this type with a ground electrode implemented as a front electrode can also be trimmed by laser beam cutting, or by water jet cutting. Just like wire erosion, these methods permit not only spark gaps delimited by flat surfaces, but also spark gaps with predefined width delimited by profiled surfaces.

In spark plugs whose spark gap surrounds a lateral surface of the end piece of the center electrode and the ground electrode is an annular electrode that surrounds the lateral surface of the center electrode, the nominal width of the spark gap preferably is produced through sink EDM. Sink EDM can be carried out with an annular electrode that during erosion is moved in the longitudinal direction of the center electrode past its end piece. For this purpose, it is best for the annular electrode required for sink EDM to have a casing with an outer lateral surface and an inner lateral surface, the radial dimensions of which give the casing a thickness that, together with the gap in which the eroding sparks spark over to the surface undergoing erosion of the end piece of the center electrode or of the counterpart on the ground electrode, yields precisely the nominal width of the spark gap. In this way, it is possible to obtain a spark gap that is precisely centered on the longitudinal axis of the center electrode and has the nominal width.

It is possible to proceed analogously in the case of a spark plug in which the lateral surface of the center electrode is located opposite the end of one or more ground electrodes, for example in a spark plug that has two diagonally opposing ground electrodes, or in a spark plug that has three ground electrodes that mutually enclose an angle of 120° and whose counterparts are pointed toward the lateral surface (circumferential surface) of the end piece of the center electrode. In this case, as well, the spark gaps can be trimmed simultaneously through sink EDM with an annular electrode.

The mutually opposing surfaces delimiting the spark gap can be shaped by removal of material in such a manner that ridges are produced that are opposite valleys, and/or valleys are produced that are opposite ridges, while the predefined width of the spark gap is maintained. In particular, the mutually opposing surfaces of the end piece placed on the center electrode and of the counterpart placed on the ground electrode can be designed with a corrugated or zigzag shape. In this way, the electrode consumption occurring in operation of the spark plug can be distributed over a larger area while maintaining the predefined width of the spark gap, thereby extending the service life of the spark plug.

It is useful for the center electrode to be designed as a circular cylinder at its front end in a known manner. The end piece that is welded to the front end of the center electrode also usefully is made in the shape of a circular cylinder and can have the same diameter as the front end of the center electrode, but can also have a different diameter, in particular a smaller diameter. The counterpart that is placed on the ground electrode preferably is also made in the shape of a circular cylinder. A circular cylindrical design of the center electrode, of the end piece attached thereto, and of the counterpart is not a prerequisite for the success sought with the invention, however.

DRAWINGS

Preferred exemplary embodiments of the invention will hereinafter be described in conjunction with the appended drawings, wherein like designations denote like elements, and wherein:

FIG. 1 is a side view of a spark plug according to one embodiment;

FIG. 2 shows an enlargement of the detail A of the spark plug from FIG. 1;

Figure 5:
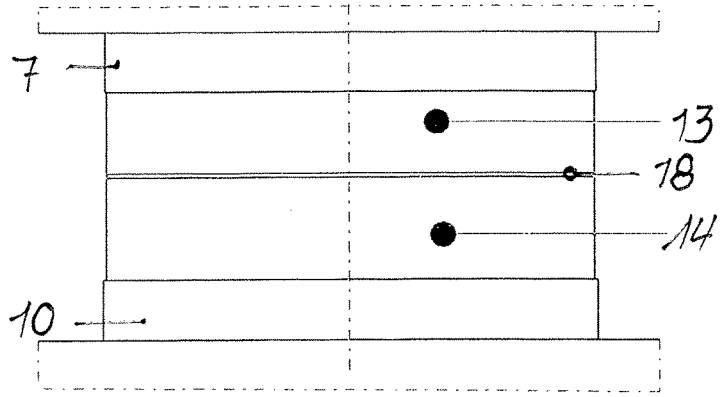
Figure 6:
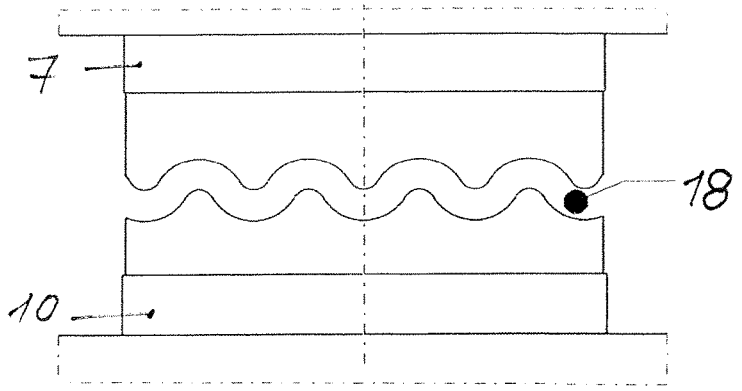
Figure 7:
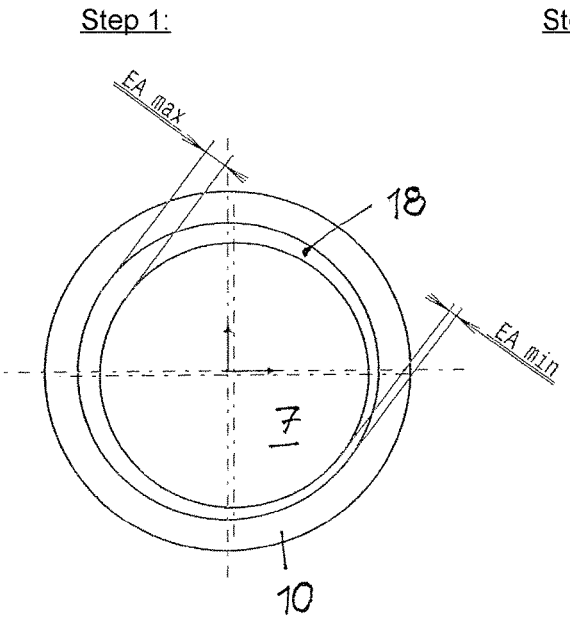
Figure 8:
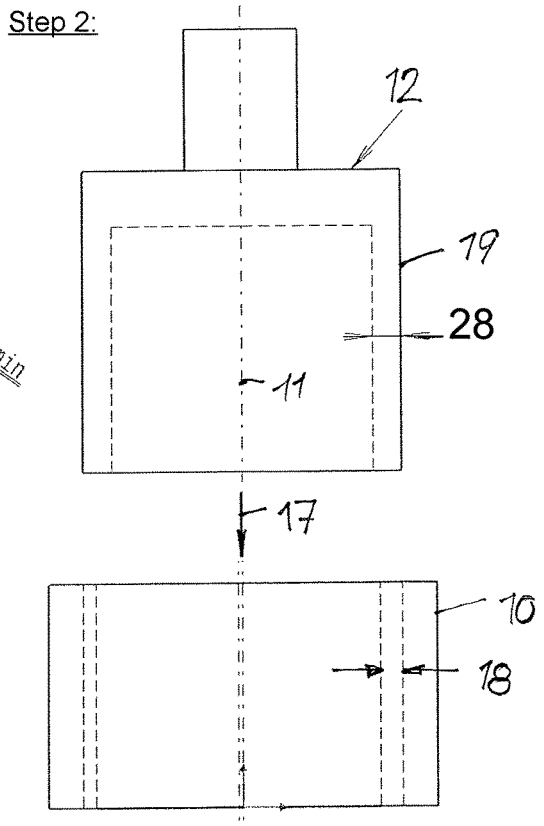
Figure 9:
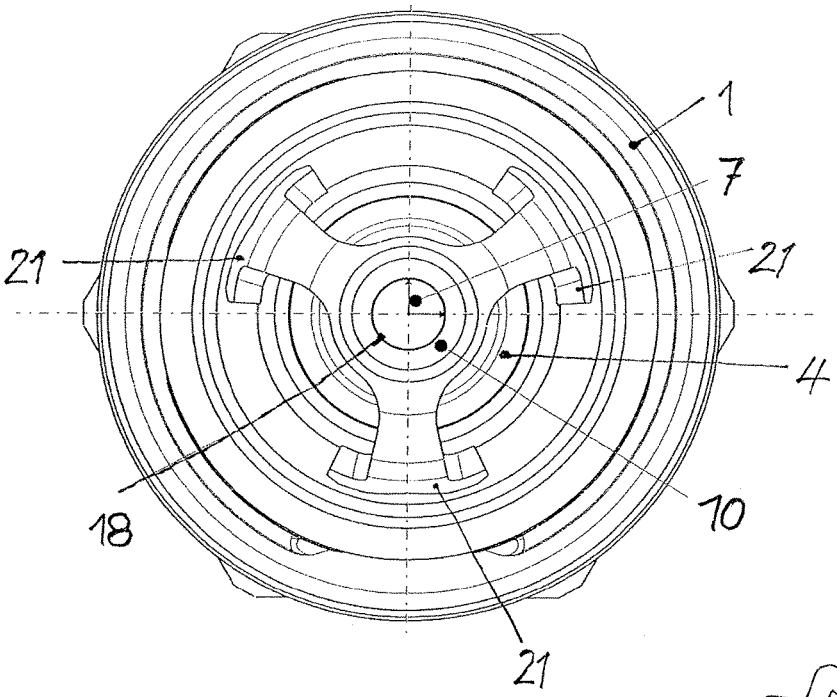
Figure 10:
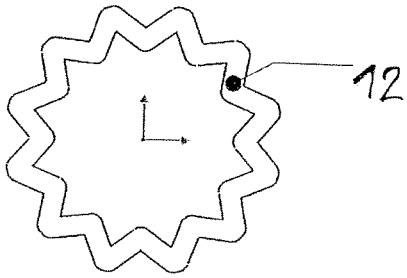
Figure 11:
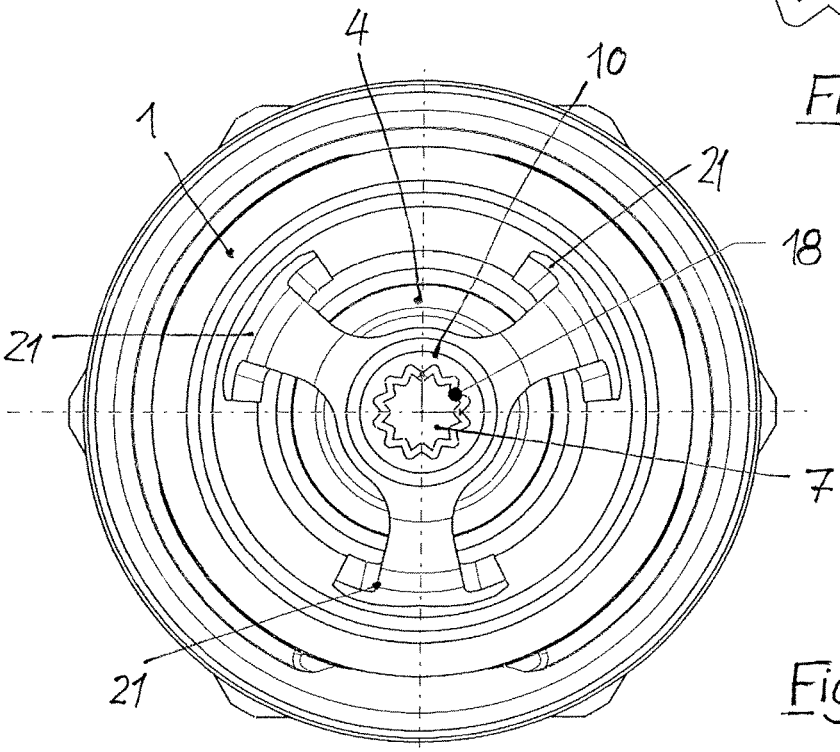

FIG. 3 schematically shows, in a side view, the spark gap of a spark plug of the type shown in FIG. 1 prior to a trimming process;

FIG. 4 shows the spark gap from FIG. 3 after a trimming process;

FIG. 5 shows a side view in a larger scale of the arrangement of the center electrode in a spark plug of the type shown in FIG. 1 with a preliminary spark gap whose width is far smaller than its nominal width;

FIG. 6 shows the arrangement from FIG. 5 in a side view after a trimming process;

FIG. 7 shows a top view of the end face of a center electrode of a spark plug as well as of an annular ground electrode surrounding the center electrode to form an annular spark gap that, because of an incorrect eccentric position of the center electrode relative to the ground electrode, does not have a uniform width smaller than the nominal width;

FIG. 8 schematically shows how the spark gap from FIG. 7 can be trimmed to its nominal width through sink EDM by means of a cup-shaped electrode;

FIG. 9 shows a top view of the front end of a spark plug with a preliminary spark gap between an annular ground electrode and a circular cylindrical center electrode, wherein the width of the spark gap is initially much smaller than the nominal width;

FIG. 10 shows, in an enlarged scale as compared to FIG. 9, a top view of the free end of an annular electrode folded in the circumferential direction for producing a correspondingly folded annular spark gap in the spark plug from FIG. 9 through sink EDM; and FIG. 11 shows the spark plug from FIG. 9 with the folded annular spark gap, produced through sink EDM with an annular electrode having the profile shown in FIG. 10.

Like or corresponding parts are labeled with matching reference numbers in the figures.

DESCRIPTION

The spark plug shown in FIG. 1 has a metallic shell 1 with a front end 2 and a back end 3. Inserted in the shell 1 is an insulator 4, which has a front end 5 and a back end 6, which projects out of the back end 3 of the shell 1. Inserted in the insulator 4 is a center electrode 7, which has a front end 8 and a back end 9. The back end 9 of the center electrode 7 projects beyond the back end 6 of the insulator 4 and is implemented as an electrical terminal. For the majority of its length, the center electrode 7 is made of a base metal, for example of a nickel alloy. Welded onto the front end 8 of the center electrode 7, which projects out of the front end 5 of the insulator 4, is an end piece 13, which is made of a precious metal or a precious metal alloy. The end piece 13 can have the same diameter as the adjacent base-metal section of the center electrode 7. Preferably, the end piece 13 is a body in the form of a circular cylinder.

Welded onto the front end 2 of the shell 1 is a ground electrode 10, which is designed as a front electrode and usefully is made of the same material as the shell 1. The term "front electrode" is meant to express that the ground electrode 10 is designed with a hook shape and its free end section 10*a* opposes the end face of the end piece 13. The spark plug shown in FIG. 1 can be produced as follows, for example:

The shell 1, the ceramic insulator 4, and the center electrode 7 are prefabricated individually. The end piece 13, which is made of a precious metal or a precious metal alloy, for example platinum or iridium or a platinum alloy or an iridium alloy, in particular of a platinum-based alloy or an iridium-based alloy, is welded onto the front end 8 of the center electrode 7 and includes a surface 25 . The ground electrode 10 is also prefabricated. The counterpart 14, which can be made of the same material as the end piece 13, is welded laterally to the free end section 10*a* of the ground electrode 10 and includes a surface 26 which, together with the surface 25, delimit the spark gap.

In order to assemble the spark plug, the center electrode 7 is pushed from behind into the insulator 4 to a stop and fixed in place therein. This is not shown in FIG. 1, but is generally known for spark plugs.

Together with the center electrode 7 inserted in it, the insulator 4 is pushed from behind into the shell 1 until its front external shoulder strikes an internal shoulder of the shell 1. These two shoulders are usefully conical in design, and in this way contribute to centering of the insulator 4 in the shell 1. In order to fix the insulator 4 in place in the shell 1, the back end 3 of the shell 1 can be crimped inward against a back external shoulder of the insulator 4.

For the sake of completeness, it is mentioned that an external thread 15 can be provided on the front section of the shell 1, with which thread the spark plug can be screwed into a matching threaded bore in the cylinder head of an internal combustion engine. A seal ring 19 can be provided adjacent to the external thread 15.

Once the insulator 4 is fixed in place in the shell 1, the ground electrode 10 is attached by welding to the front end 2 of the shell 1 such that the counterpart 14 opposes the end piece 13 of the center electrode 7.

The spark gap 18 is shown in FIG. 2 and is supposed to have a nominal width of, for example, 0.8 mm.

Inaccuracies in the spark gap 18 can be prevented with the method. For this reason, it is preferred to provisionally create the spark gap 18 such that it is narrower at every point than its nominal width. Moreover, an unwanted, incorrect orientation of the end piece 13 and counterpart 14 relative to one another is shown in FIG. 4, so that the preliminary spark gap 18 has a wedge shape. By means of the method, the spark gap can be trimmed to its nominal width, and at the same time the wedge shape of the spark gap 18 shown in FIG. 3 can be corrected. This can be accomplished through wire erosion. FIG. 3 shows a wire 16 intended for wire erosion, in cross-section, in its position prior to the start of the erosion process. The wire 16 can be moved at right angles to itself in the direction of the arrow 17, in contact with one of the two surfaces delimiting the spark gap 18, through the spark gap 18, in which process it expands the spark gap through electrical discharge machining. FIG. 4 shows the wire 16 after the conclusion of the erosion process, which has resulted in a spark gap 18 that is delimited by flat surfaces and that has the nominal width.

As is known, electrical discharge machining is brought about by the means that the wire 16 is electrically connected as a cathode, whereas the surface to be machined is connected as an anode. As the wire 16 approaches the surface to be machined, sparks jump from the wire 16 to the surface to be machined and bring about an erosion of the surface to be machined. The gap between the wire 16 and the surface to be machined is typically a few hundredths of a millimeter wide, depending on the level of the voltage applied and on the intensity of the current. The width of the spark gap that was expanded through wire erosion thus is the result of the diameter of the wire 16 plus the width of the gap [between the tool and the workpiece], which can be experimentally determined in advance.

During erosion, the wire can either glide along the surface of the end piece 13 or along the surface of the counterpart 14. The erosion then takes place at the particular surface from which the wire 16 maintains an appropriate distance while forming the gap [between the tool and the workpiece].

The spark gap 18 that is coming into being is delimited by two parallel surfaces, see FIG. 4. These surfaces may extend at right angles to the longitudinal axis 11 of the center electrode 7, but this does not have to be the case. It can even be advantageous for the spark gap 18 to extend obliquely to the longitudinal axis 11 of the center electrode 7, because then the surfaces delimiting the spark gap 18 are larger than they would be if they were perpendicular to the longitudinal axis 11, so that the electrode consumption occurring during operation of the spark plug can be distributed over a larger area than if the surfaces delimiting the spark gap 18 were precisely at right angles to the longitudinal axis 11 of the center electrode 7. This extends the service life of the spark plug.

The surfaces delimiting the spark gap 18 need not be flat. FIGS. 5 and 6 show how a spark gap 18 with a corrugated or zigzag shape (see FIG. 6) can be formed by wire erosion in a spark plug having a spark gap 18 that is initially made with only a very narrow width (see FIG. 5) between the end piece 13 on the center electrode 7 and the counterpart 14 of the ground electrode 10. As a result of the corrugated shape or zigzag shape, the two surfaces delimiting the spark gap 18 are greatly enlarged while the width of the spark gap 18 remains unchanged, so that the electrode consumption occurring during operation of the spark plug can be distributed over the enlarged areas, thus significantly increasing the service life of the spark plug.

FIGS. 7 and 8 show how, in the case of a spark plug in which the ground electrode 10 surrounds the center electrode 7 in an annular shape, the annular spark gap 18, which, because of an unintentional eccentricity does not have a uniform width—see FIG. 7—but instead has a width that varies between a maximum width EAmax and a minimum width EAmin, can be trimmed by sink EDM such that the spark gap 18 has its nominal width everywhere and no longer exhibits any eccentricity. In order to be able to carry out the method, the width of the preliminary spark gap 18 is selected such that the maximum width EAmax≤the nominal width, preferably less than the nominal width. To carry out the method, it is possible to use for the sink EDM a cup-shaped electrode 12 that has a circular cylindrical casing 19, whose external diameter determines the internal diameter of the annular ground electrode 10 that is present after the sink EDM, whereas the internal diameter of the casing 19 of the electrode 12 determines the external diameter that is present of the end piece 13 of the center electrode 7 after the sink EDM. The nominal width of the spark gap 18 minus the width of the gap [between the tool and the workpiece]

required for the electrical discharge machining, which can be determined in advance for the given application by experiment, is selected as the wall thickness 28 of the casing 19 of the electrode 12. To perform sink EDM, the electrode 12 can be moved coaxially to the longitudinal axis 11 of the ground electrode 10, gliding along the same in the direction of the arrow 17, with the gap between the electrode 12 and the end piece 13 of the center electrode that is required for electrical discharge machining being maintained. Alternatively, the internal diameter of the casing 19 of the electrode 12 can be matched to the external diameter of the end piece 13, and the gap can be formed between the external surface of the casing 19 of the electrode 12 and the surface of the counterpart 14 of the ground electrode 10 facing the end piece 13.

FIG. 9 shows a top view of the front end of a spark plug with a preliminary spark gap 18 between an annular ground electrode 10 and a circular cylindrical center electrode 7, wherein the width of the spark gap 18 is initially much smaller than its nominal width. The annular ground electrode 10 has three feet 21, which are welded to the front end 2 of the shell 1.

With an annular electrode 12, whose contour is shown greatly enlarged in FIG. 10, the spark gap 18 can be enlarged to its nominal width through sink EDM. In the example from FIG. 10, the annular electrode 12 has a shape folded in a zigzag. It is moved coaxially to the longitudinal axis 11 of the center electrode 7 in the spark gap 18, which is expanding as a result of electrical discharge machining, so that it removes material both from the outer lateral surface of the center electrode 7 and from the inner lateral surface of the ground electrode 10 by electrical discharge machining, and creates a spark gap 18 that is folded in a zigzag shape corresponding to the shape of the electrode 12, wherein the width of the spark gap 18 is the same everywhere. Compared to a conventional circular cylindrical spark gap, the zigzag spark gap 18 is distinguished by the fact that the surfaces delimiting it are larger than in a comparable circular cylindrical spark gap. The electrode consumption occurring at the surfaces delimiting the spark gap 18 during operation of the spark plug is thus distributed over a larger area, which results in a longer service life.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

1 shell
2 front end of 1
3 back end of 1
4 insulator
5 front end of 4
6 back end of 4
7 center electrode
8 front end of 7
9 back end of 7
10 ground electrode
10*a* end section of 10
11 longitudinal axis of 7
12 electrode for the EDM process
13 end piece
14 counterpart
15 external thread
16 wire
17 arrow
18 spark gap
19 casing of 12
20 seal ring
21 feet of 19

The invention claimed is:

1. A method for producing a spark plug for internal combustion engines, having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and that has a front end that projects from the front end of the insulator;

at least one ground electrode that is attached to the front end of the shell; and an end piece made of a precious metal or a precious metal alloy is attached to the front end of the center electrode, and a counterpart made of a precious metal or a precious metal alloy is attached to the ground electrode opposite the end piece, between which is formed a spark gap that has a nominal width;

the method comprising the steps of:

initially producing a spark gap with a width that is smaller, at least in places, than the nominal width; and subsequently bringing the spark gap to its nominal width by the removal of material from at least one of a surface of the end piece and a surface of the counterpart that delimit the spark gap, wherein the removal of material from at least one of the two surfaces delimiting the spark gap is accomplished through sink electrical discharge machining (EDM).

2. The method according to claim 1, wherein the spark gap is initially produced with a width that is no greater than the nominal width at any part of the spark gap.

3. The method according to claim 1, wherein, in spark plugs whose spark gap surrounds a lateral surface of the end piece of the center electrode, the nominal width of the spark gap is produced through sink EDM.

4. The method according to claim 1, wherein the mutually opposing surface of the end piece and the surface of the counterpart that delimit the spark gap are shaped by removal of material in such a manner that one or more ridges and one or more valleys are produced that are opposite one another, while a predefined width of the spark gap is maintained.

5. The method according to claim 4, wherein the surface of the end piece and the surface of the counterpart that delimit the spark gap are designed such that they have a zigzag shape or corrugated shape.

6. A method for producing a spark plug for internal combustion engines, having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and that has a front end that projects from the front end of the insulator;

at least one ground electrode that is attached to the front end of the shell; and an end piece made of a precious metal or a precious metal alloy is attached to the front end of the center electrode, and a counterpart made of a precious metal or a precious metal alloy is attached to the ground electrode opposite the end piece, between which is formed a spark gap that has a nominal width;

the method comprising the steps of:

initially producing a spark gap with a width that is smaller, at least in places, than the nominal width; and subsequently bringing the spark gap to its nominal width by the removal of material from at least one of a surface of the end piece and a surface of the counterpart that delimit the spark gap, wherein the removal of material from at least one of the two surfaces delimiting the spark gap is accomplished through electrical discharge machining (EDM), wherein, in spark plugs whose spark gap surrounds a lateral surface of the end piece of the center electrode, the nominal width of the spark gap is produced through sink EDM, wherein the sink EDM is performed with an annular electrode.

7. A method for producing a spark plug for internal combustion engines, having:

a metallic shell that has an open front end and an open back end;

a ceramic insulator, held in the shell, that has a front end and a back end that projects from the back end of the shell;

a center electrode, embedded in the insulator, that has a back end that projects from the back end of the insulator and that has a front end that projects from the front end of the insulator;

at least one ground electrode that is attached to the front end of the shell; and an end piece made of a precious metal or a precious metal alloy is attached to the front end of the center electrode, and a counterpart made of a precious metal or a precious metal alloy is attached to the ground electrode opposite the end piece, between which is formed a spark gap that has a nominal width;

the method comprising the steps of:

initially producing a spark gap with a width that is smaller, at least in places, than the nominal width; and subsequently bringing the spark gap to its nominal width by the removal of material from at least one of a surface of the end piece and a surface of the counterpart that delimit the spark gap, wherein the removal of material from at least one of the two surfaces delimiting the spark gap is accomplished through electrical discharge machining (EDM), wherein, in spark plugs that have at least two ground electrodes or one ground electrode with at least two counterparts pointed toward a lateral surface of the end piece of the center electrode, the nominal width of the spark gap is produced through sink EDM.

8. The method according to claim 7, wherein the sink EDM is performed with an annular electrode.

9. The method according to claim 8, wherein during erosion, the annular electrode is moved in a direction of the longitudinal axis of the center electrode that is coaxially to the center electrode.

* * * * *